United States Patent [19]

Rider

[11] Patent Number: 5,031,387

[45] Date of Patent: Jul. 16, 1991

[54] ADJUSTABLE CINCH BELT FOR A SADDLE AND METHOD THEREFOR

[76] Inventor: Jimmy R. Rider, 176 Baxter Rd., Pueblo, Colo. 81006

[21] Appl. No.: 447,377

[22] Filed: Dec. 7, 1989

[51] Int. Cl.[5] ..... B68C 1/14

[52] U.S. Cl. ..... 54/23; 54/46

[58] Field of Search ..... 54/44, 23, 46

[56] References Cited

U.S. PATENT DOCUMENTS

| | | | |
|---|---|---|---|
| 1,397,128 | 11/1921 | Keithley | 54/46 |
| 3,205,637 | 9/1965 | Welton | 54/46 |
| 4,141,198 | 2/1979 | Gaertner | 54/46 |
| 4,905,458 | 3/1990 | Johnston et al. | 54/23 |

*Primary Examiner*—Robert P. Swiatek

*Attorney, Agent, or Firm*—Dorr, Carson, Sloan & Peterson

[57] ABSTRACT

The present invention provides an adjustable cinch belt for a saddle. The belt uses two straps designed to slide relative to one another to adjust the length of the belt. A three pronged locking plate secures the straps together to prevent unintentional movement of the straps to stop accidental loosening of the belt. The belt is designed for use as a girth cinch belt as well as a flank cinch belt in another embodiment.

25 Claims, 3 Drawing Sheets

Fig. 1
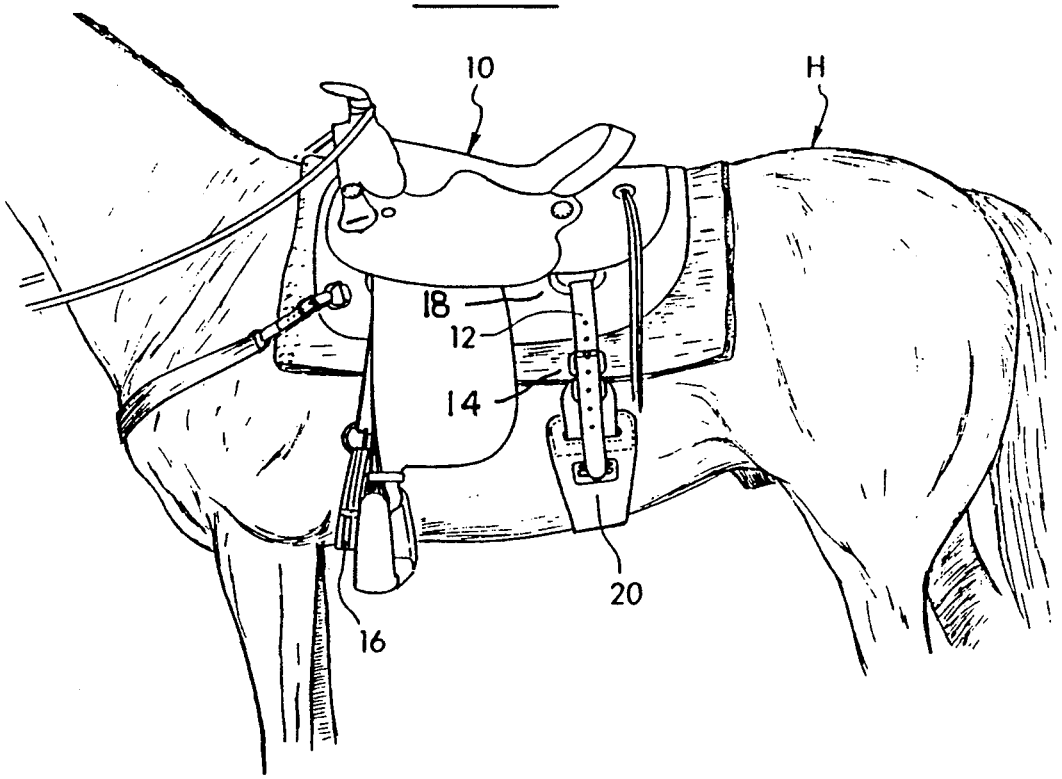
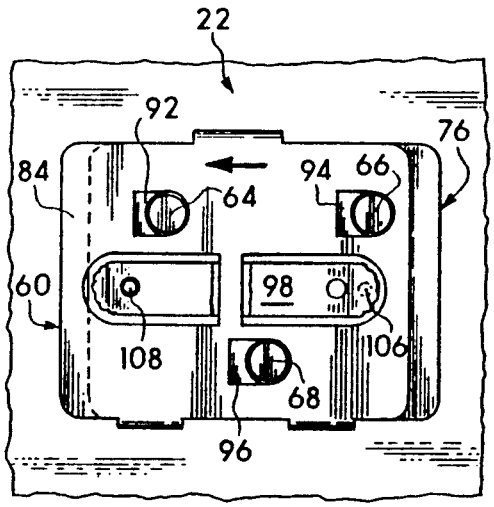
Fig. 6
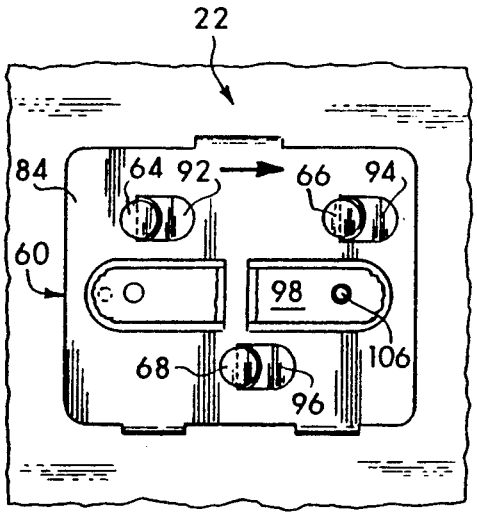
Fig. 7

ADJUSTABLE CINCH BELT FOR A SADDLE AND METHOD THEREFOR

BACKGROUND OF THE INVENTION

1. Field of the Invention

This invention relates to the field of cinch belts for riding saddles.

2. Statement of the Problem

A riding saddle will normally be secured to a horse by a girth cinch belt and a flank cinch strap. The cinch belts of the prior art are typically of a pre-determined size. This limits the use of a single belt to a narrow range of saddles and horses. Should the saddle be desired to be used on a horse having a girth different than the horse that the original cinch belt was used for or should a different size saddle be used, it is necessary to buy another cinch belt for that horse or saddle. Since a rider will use a particular saddle for a number of years on a variety of horses as well as use a number of different sizes of saddles, the accumulation of a variety of cinch belts can create a large expense for the saddle user.

There currently exists a need for a cinch belt which can be used on a variety of saddles and on a variety of differing sizes of horses.

3. Solution to the problem

The current invention solves this problem and others by providing a cinch belt capable of being securely adjusted to a range of lengths to accommodate the use of either a single saddle on differing sizes of horses or used with a variety of saddles on different sizes of saddles and horses.

The adjustable belt of the current invention is designed not only for use as a girth cinch belt but in another embodiment, also as a flank cinch belt.

SUMMARY OF THE INVENTION

The present invention provides an adjustable cinch belt which can be used on a wide range of saddles and horses. The belt can be easily adjusted and safely secured.

The belt of the present invention includes two similarly shaped straps. Each of the straps have a narrow proximate end portion and a wider distal end portion. The first strap includes a single transverse slit formed in its distal end portion and a plurality of holes formed in a single triad pattern. The second strap includes two parallel transverse slits in its distal end portion and a repetitive triad pattern of holes. The proximate end portion of the first strap is inserted into the slits of the second strap while the proximate end portion of the second strap is inserted in the slit of the first strap.

The straps are thus able to move relative to one another while interconnected to each other. The wide distal ends prevent the straps from pulling out of the slits.

A locking plate with three upstanding prongs is inserted through the holes of the strap to lock the straps together once the belt has been adjusted to a desired length. A sliding plate engages notches in the prongs to prevent the straps from dislodging from the prongs.

These and other features are more clearly set forth in the detailed description of the preferred embodiment in conjunction with the drawings.

BRIEF DESCRIPTION OF THE DRAWINGS

FIG. 1 shows the adjustable cinch belt of the current invention secured on a saddle mounted on a horse.

FIG. 6 is a bottom view of the locking mechanism in the unlocked position.

FIG. 7 is a bottom view of the locking mechanism is the locked position.

DETAILED DESCRIPTION OF THE PREFERRED EMBODIMENT

Figure 2:
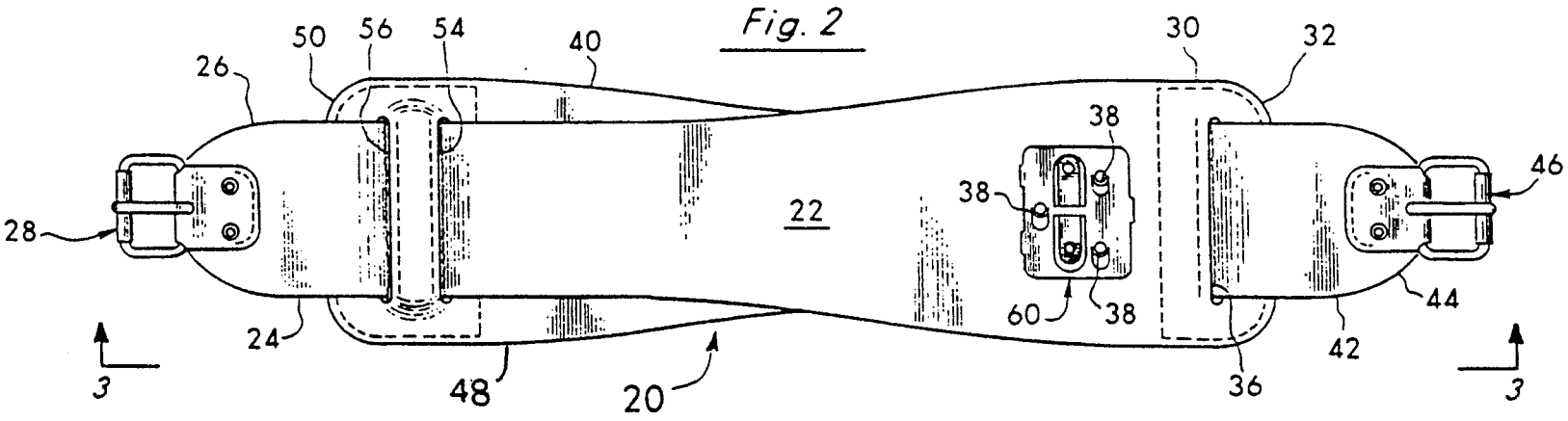
FIG. 2 illustrates a bottom view of the adjustable cinch belt of the current invention.

The preferred embodiment of the cinch belt of the present invention is illustrated in FIG. 1. A saddle 10 is shown mounted onto a horse, H. The saddle 10 is secured on the horse by the flank cinch strap 16 and the girth cinch strap 20. The current invention can be used not only as illustrated as the girth cinch strap 20 but in another embodiment, as the flank strap 16. The cinch straps are attached to the saddle by buckles 14 and strap 12 which typically are fastened to a "D" ring 18 on the saddle. Other fastening means are available as well, normally depending on the particulars of the saddle used.

Figure 3:
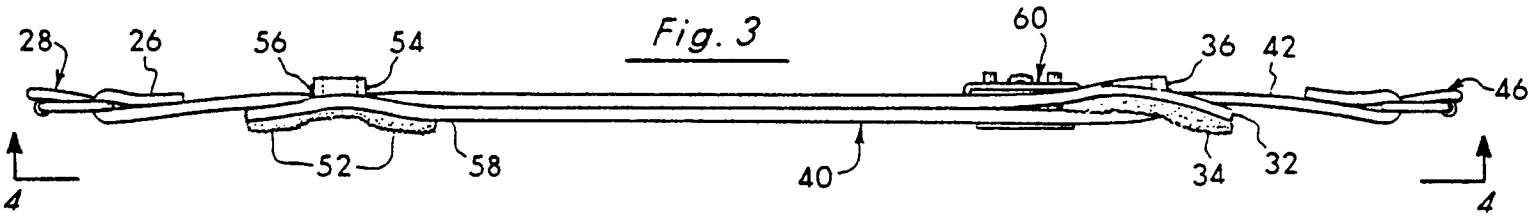
FIG. 3 is a side view along line 3—3 of FIG. 2.
Figure 4:
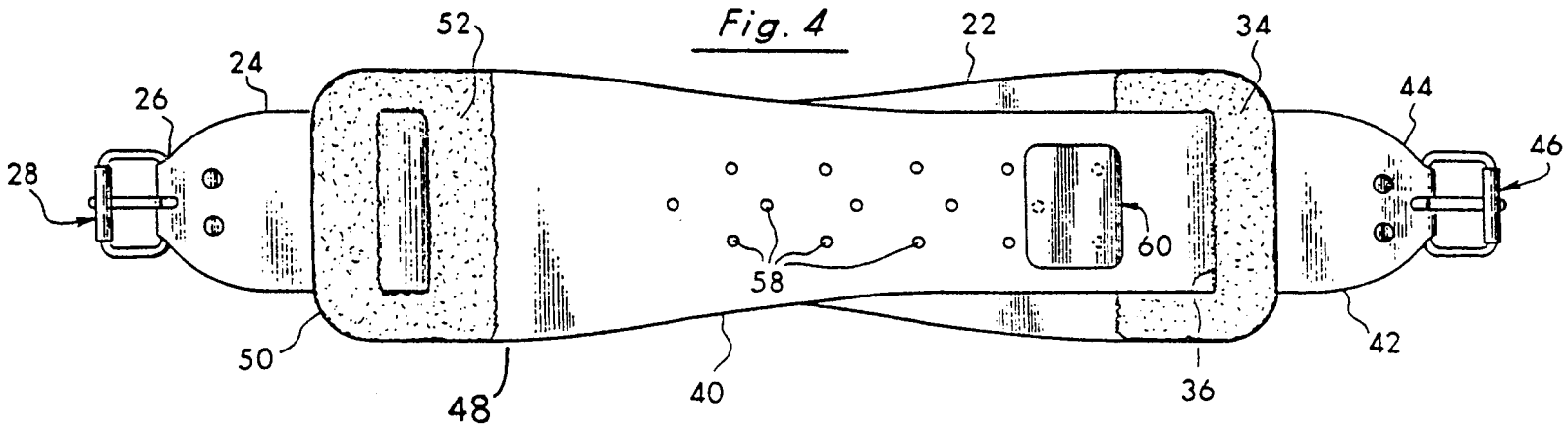
FIG. 4 is a top view along line 4—4 of FIG. 3.

The cinch belt of the present invention is illustrated as a girth cinch strap for descriptive purposes. The belt 20 as illustrated in FIGS. 2–4, includes two separate, similarly shaped straps, 22 and 40 connected together. The straps, 22 and 40 are formed from leather or other suitable materials. The proximate end portion 24 of strap 22 has an elongated, substantially rectangular shape with a tapered end portion 26. The invention is not meant to be limited to this design, but other shapes can be utilized as well. Buckle 28 is attached to the end portion 26 by well-known means, such as rivets. Other types of attachment means other than buckles can be used, depending on the type of saddle on which the cinch strap is attached.

The distal end portion 30 of the strap 22 tapers outwardly from the proximate end portion 24 to a relatively wider distal end 32. The distal end has a rectangular shape with beveled corners. A pad 34 is sewn on the back side of the distal end 32 to prevent chafing or abrasion to the horse. The pad can be formed from sheepskin or other suitable materials.

A slit 36 is formed in the distal end portion 30 of the strap near the distal end 32. The slit 36 is formed parallel to and spaced from the distal end 32 and perpendicular to the elongated axis of the strap. The slit has a width and length slightly larger than the thickness and width of the proximate end portion of the second strap 40. A plurality of spaced holes 38 are formed in the proximate end portion of the strap 22. The holes 38 are spaced in a triad pattern, with two holes spaced in the transverse direction and one hole lying between them spaced therefrom along the elongated axis of the strap. Other patterns of holes can be used depending on the pattern of the prongs of the base plate as discussed below.

The second strap 40 is formed similar to the first strap 22. The second strap 40 includes a substantially rectangular proximate end portion 42 having a tapered proximate end 44. Buckle 46 is attached to the proximate end 44 for attaching the belt to the saddle. The distal end portion 48 tapers outwardly from the proximate end portion to a relatively wider, substantially rectangular distal end 50 having rounded corners. A pad 52 is sewn on the back side of the distal end portion to prevent chafing or abrasions to the horse.

The second strap 40 has two transverse slits 54 and 56 formed in the distal end portion 48. The slits are formed spaced from and parallel to the distal end 50 of the strap and perpendicular to the elongated axis of the strap. The slits are spaced from and parallel to one another as well. The width and length of the slits are slightly greater than the width and thickness of the proximate end portion 24 of the first strap 22.

Holes 58 are formed in the proximate end portion 42 of the second strap 40 in a repetitive triad pattern similar to the single pattern of holes 38 of the first strap 22.

The proximate end 26 of the first strap is inserted through the first slit 54 from the top side of the second strap 40 and then inserted back through the second slit 56 from the back side of the second strap. The first strap is then pulled through so the proximate end portion 24 is fully inserted through the two slits.

The proximate end 44 of the second strap 40 is inserted through slit 36 from the back side of the first strap 22. The second strap is then pulled through so the proximate end portion 42 is fully inserted through the slit 36. The straps are prevented from being pulled entirely through the slits 36, 54 and 56 since the distal end portions of both straps are substantially wider than the length of the slits. The above described apparatus, including the straps and slits, is for descriptive purposes and is not meant to limit the scope of the claimed invention. Other devices can be used in lieu of the slits to provide relative movement of the straps. Also other designs other than the wide distal end portions can be utilized to prevent the straps from coming apart.

Figure 5:
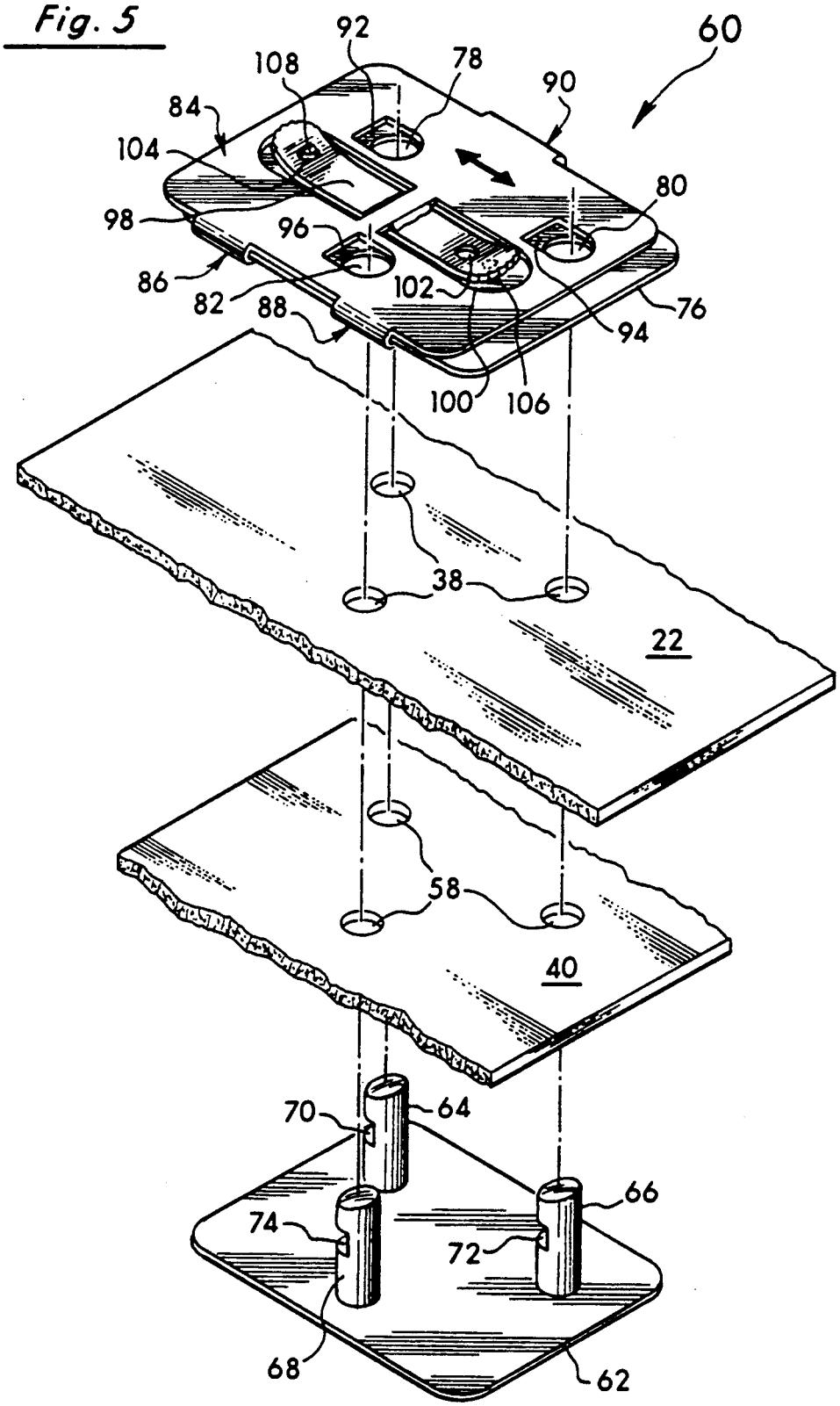
FIG. 5 is an exploded view of the locking mechanism of the invention.

The length of the belt 20 is adjustable by the movement of the straps 22 and 40 relative to one another. Locking mechanism 60 is provided to secure the straps 22 and 40 from relative movement once the belt has been adjusted to the proper length. The locking mechanism 60 is illustrated in FIGS. 2–7. The locking mechanism as shown in FIG. 5 includes a substantially rectangular base plate 62 which has three upstanding prongs 64, 66, and 68. Each of the prongs 64, 66, and 68 has a notch 70, 72, and 74 formed near its free end. The base plate is formed from a high strength plastic or other material or covered with a suitable material to prevent abrasion to the horse.

The prongs are formed on the base plate 62 in the same triad pattern as the holes 38 and 58 in the straps 22 and 40. The belt is adjusted to a position where the length is approximately correct and the three holes 38 and three of the holes 58 are aligned. The prongs 64, 66, and 68 of the base plate 62 are then inserted into the holes from the back side of the strap 40. The prongs thus prevent the straps from moving relative to one another so the belt will not accidentally loosen. Any number or pattern of prongs on the base plate can be used within the scope of the invention.

A locking plate 76 is secured to the prongs on the top side of strap 22 to prevent the straps from separating from the prongs. The plate 76 includes three holes 78, 80, and 82 formed in the plate 76 in a matching pattern as the prongs. A substantially rectangular sliding plate 84 is mounted on the locking plate 76 by clips 86, 88, and 90. The sliding plate 84 is designed to slide in the direction of the elongated axis of the locking plate 76 but is restrained from other movement relative to the locking plate.

Three "D" shaped holes 92, 94, and 96 are formed in the sliding plate 84 in substantially the same pattern as the three prongs 64, 66, and 68. The curved portion of the "D" shaped holes have the same radius as the holes of the locking plate 76. The squared portion of the "D" shaped holes are slightly larger than the diameter of the holes of the locking plate.

The holes 78, 80, 82 of the locking plate 76 are placed over the prongs 64, 66, 68 of the base plate. The sliding plate 84 is moved relative to the locking plate 76 and the prongs until the squared edge of the "D" shaped holes engage the notches 70, 72, and 74 as illustrated in FIG. 7. This engagement secures the locking plate 76 to the prongs 64, 66, and 68 so the straps 22 and 40 are restrained from coming loose from the prongs thus preventing accidental loosening of the belt 20. The sliding plate is moved relative to the locking plate in the opposing direction as illustrated in FIG. 6 to release the locking plate from the prongs.

A spring lever 98 is used to prevent the sliding plate 84 from moving out of engagement with the notches. The spring lever 98 is attached to the sliding plate 84 within an elongated slot 100 formed centrally in the sliding plate. Holes 102 and 104 are formed in the lever adjacent either end of the lever 98. Upstanding pins 106 and 108 are mounted on the locking plate 76 to lie within the elongated slot 100 of the sliding plate. The pin 106 is mounted in a position so that as the sliding plate fully engages the notches of the prongs, the pin 106 engages the hole 102 of the spring lever. The sliding plate is thus restrained from moving out of the notches. Pin 108 is mounted to engage the hole 104 of the spring lever when the sliding plate is fully out of engagement with the notches so the locking plate can be released from the prongs. Other variations can be used instead of the prongs and locking plates, such as clevis pins, within the scope of the invention. Also other shapes and designs of base plate, the locking plate and sliding plate can be used.

In use, the belt 20 is designed to be adjustable over a wide range of lengths. Once the two strap portions are interconnected, the belt can be quickly and easily adjusted. The sliding plate is moved so that it no longer engages the notches on the prongs of the base plate. The locking plate 76 can then be removed from the prongs so the prongs can be pulled through the holes in the straps. The straps 22 and 40 can then be moved relative to one another until the holes 38 and 58 which align nearest the desired length are found. The prongs of the locking plate are then reinserted into the holes 38 and 58 and the locking plate 76 is then replaced over the prongs. The end of the spring lever which is engaged by pin 108 is pulled up to release the sliding plate 84. This allows the plate 84 to be moved relative to the locking plate 76 until the notches in the prongs are fully engaged by the sliding plate. The pin 106 will then engage the spring lever to restrain the sliding plate from becoming accidentally dislodged. Final adjustment of the cinch belt can be performed by the use of the buckles 28 and 46 and the strap 14.

The present invention allows a single cinch belt to be used for a wide range of saddles and a variety of horses without the expense of investing in multiple cinch belts. The cinch belt of the present invention can be used as a girth cinch belt or in another embodiment it can be used as a flank cinch belt. The belt can be easily adjusted to desired lengths and secured to prevent accidental loosening. The straps of the belts are designed to merely loosen rather than come completely apart should the locking mechanism become dislodged.

The above description of the preferred embodiment is merely for descriptive purposes and is not meant to limit the scope of the claimed invention. Other variations are considered to be within the inventive range of the present invention.

I claim:

1. A cinch belt for use with a saddle, said cinch belt comprising a first elongated strap portion, a separate second elongated strap portion, means to attach each of said strap portions to a saddle, means to securely connect said first strap portion and said second strap portion together at a selected adjusted position to form a single strap, means to adjust the length of said single strap including a first transverse slot means formed near the distal end of said first strap portion for the proximate end of said second strap portion to be inserted through said first transverse slot means and means to prevent the distal end of said second strap portion from sliding through said first transverse slot means; and means to lock said strap to a desired length to prevent accidental change in the length of said strap.

2. The cinch belt of claim 1 wherein said means to prevent said distal end of said second strap portion from sliding through said first transverse slot means comprise said distal end having a wider dimension than the width of said first transverse slot means.

3. The cinch belt of claim 1 wherein said adjustment means further comprise a second transverse slot means on said second strap portion for the proximate end of said first strap portion to be inserted therein; said second transverse slot means spaced from and parallel to said first transverse slot means and said proximate end of first strap portion inserted into said second transverse slot means.

4. The cinch belt of claim 3 wherein said means to prevent said distal end of said second strap portion from sliding through said first transverse slot means further comprises said distal end having a wider dimension than the width of said first transverse slot means and said second transverse slot means.

5. The cinch belt of claim 3 wherein said adjustment means further comprise a third transverse slot means formed near the distal end of said second strap portion; and the proximate end of said first strap portion is inserted into said third transverse slot means.

6. The cinch belt of claim 5 wherein said distal end of said first strap portion has a wider dimension than said third transverse slot means to prevent said distal end of said first strap portion from slipping through said third transverse slot means.

7. The cinch belt of claim 1 wherein said locking means comprise a plurality of holes formed in said first strap portion;

a plurality of holes formed in said second strap portion;

a first locking plate with at least one upstanding prong on said first locking plate, said at least one upstanding prong insertable through at least one of said plurality of holes in said first strap portion and through at least one of said plurality of holes in said second strap portion when said first strap portion and said strap portion overlap one another in a selected adjusted position;

a second locking plate with holes formed therein matching said at least one upstanding prong, whereby said at least one upstanding prong is inserted through said matching holes as said at least one upstanding prong is inserted through said at least one plurality of holes in said first strap portion and said second strap portion; and means to lock said first locking plate and said second locking plate together after said at least one upstanding prong has been inserted through said matching holes of said second locking plate.

8. The cinch belt of claim 7 wherein said plate locking means comprise notches formed near the free end of each of said at least one prongs;

a third plate slidable mounted on said second plate with holes matching said holes in said second plate formed in said third plate having edges to engage said notches; and spring biasing means to bias said edges into engagement with said notches to lock said plates together.

9. The belt of claim 8 wherein said biasing means further include means to bias said slots in an unlocked position so said at least one prong can be inserted in said second plate.

10. The belt of claim 9 wherein said biasing means comprise a first pin mounted on said second plate; a second pin mounted on said second plate spaced from said first pin; an elongated spring clip mounted on said third locking plate; a first hole formed near one end of said spring clip to releasably engage said first pin when said slots engage said at least one prong and a second hole formed near the second end of said spring clip to releasably engage said second pin when said slots are in said open position.

11. A saddle for use on a horse or other animal, said saddle comprising:

a cinch belt, said belt including a first elongated strap portion having a firs transverse slot means formed near the distal end portion of said first strap portion;

a second separate elongated strap portion having a proximate end portion insertable in said first transverse slot means, said second strap portion adjustably connected to said first strap portion;

means to prevent the distal end portion of said second strap portion from sliding through said first transverse slot means;

means to securely fasten said first strap portion and said second strap portion together; and means to fasten said cinch belt to said saddle.

12. The saddle of claim 11 wherein said second strap portion includes a second transverse slot means formed near the distal end portion of said second strap portion with the proximate end portion of said first strap portion being insertable in said second transverse slot means; and means to prevent the distal end portion of said second strap portion from sliding through said second transverse slot means.

13. The saddle of claim 12 wherein said means to prevent said distal end portion of said first strap portion from sliding through said second transverse slot means comprise forming said distal end portion of said first strap portion of a wider dimension than the length of said second transverse slot means.

14. The saddle of claim 11 wherein said means to prevent said distal end portion of said second strap portion from sliding through said first transverse slot means comprises said distal end portion of said second strap portion being formed of a wider dimension than the length of said first transverse slot means.

15. The saddle of claim 11 wherein said means to secure said first strap portion and said second portion together comprises:

a plurality of holes formed in said first strap portion and in said second strap portion;

a first locking plate with at least one upstanding prong on said first locking plate, said at least one upstanding prong insertable through a matching number of said plurality of holes in said first strap portion and through a matching number of said plurality of holes in said second strap portion when said first strap portion and said strap portion overlap one another in a selected adjusted position;

a second locking plate with holes formed therein matching said at least one upstanding prong, whereby said at least one upstanding prong is inserted through said matching holes of said locking plate as said at least one upstanding prong is inserted through said matching holes of said first strap portion and said second strap portion; and means to lock said first locking plate and said second locking plate together after said at least one upstanding prong has been inserted through said matching hole of said second locking plate.

16. The saddle of claim 15 wherein said locking means comprise a notch formed near the upstanding end of each of said at least one prongs;

a third plate slidably mounted on said second locking means;

elongated slots formed in said third plate matching said holes formed in said second plate whereby said third plate slides in one direction relative to said second plate so one edge of said slots engages said notch on each of said at least one prongs to lock said first plate and said second plate together and said third plate sides in the opposing direction to disengage said edge of said slots from said notch on each of said at least one prongs to unlock said plates;

means to releasably bias said slots into engagement with said notches.

17. The saddle of claim 16 wherein said biasing means comprise spring means to bias said slots into engagement with said notches.

18. The saddle of claim 16 wherein said biasing means further include means to bias said slots in an unlocked position so said at least one prong can be inserted in said second plate.

19. The saddle of claim 18 wherein said biasing means comprise a first pin mounted on said second plate; a second pin mounted on said second plate spaced from said first pin; an elongated spring clip mounted on said third locking plate; a first hole formed near one end of said spring clip to releasably engage said first pin when said slots engage said at least one prong and a second hole formed near the second end of said spring clip to releasably engage said second pin when said slots are in said open position.

20. A cinch belt for a saddle, said belt comprising:

a first strap portion having means on the proximate end of said first strap portion to attach said first strap portion to said saddle;

a second strap portion releasably secured to said first strap portion; means on the proximate end portion of said second strap portion to attach said second strap portion to said saddle; said second strap portion moveable relative to said first strap portion to adjust the length of said strap;

means to releasably secure said first strap portion and said second strap portion together;

said first strap portion having first transverse slot means formed near the distal end portion of said first strap portion for said proximate end portion of said second strap portion to be inserted therethrough;

said second strap portion including second transverse slot means formed near the distal end portion of said second strap portion for said proximate end portion of said first strap portion to be inserted therethrough;

said distal end portion of said first strap portion formed of a wider dimension than the width of said second transverse slot means to prevent said first strap portion from sliding out of said second transverse slot means;

said distal end portion of said second strap portion formed of a wider dimension than the width of said first transverse slot means to prevent said second strap portion from sliding out of said first transverse slot means;

a plurality of holes formed in said first strap portion and a plurality of holes formed in said second strap portion; said plurality holes of said first strap portion and said plurality of holes of said second strap portion overlap as said first strap portion and said second strap portion are moved relative to one another to adjust the length of said strap;

said securing means include a first locking plate having at least one upstanding prong thereon; said at least one prong having a notch formed near the free end of said at least one prong; said at least one prong being insertable through a matching number of said plurality of holes of said first strap portion and said second strap portion when said strap is adjusted to a desired length;

said securing means further include a second locking plate having at least one hole formed therein matching said at least one prong so said at least one prong is insertable through said matching holes of said second plate after said at least one prong has been inserted through said matching number of holes of said first strap portion and said second strap portion; and said securing means further include a third locking plate slidably mounted on said second locking plate, said third locking plate having elongated slot means matching said at least one prong on said first locking plate and said least one hole on said second locking plate; and said slot means having an edge formed thereon for engaging each of said notches of said at least one prong to releasably lock said second plate to said first plate.

21. The belt of claim 20 wherein said securing means further comprise spring means to bias said slots into engagement with said notches.

22. The belt of claim 21 further wherein said securing means further include means to bias said slots in an unlocked position so said at least one prong can be inserted in said second plate.

23. The belt of claim 22 wherein said biasing means comprise first pin mounted on said second plate; a second pin mounted on said second plate spaced from said first pin; an elongated spring clip mounted on said third locking plate; a first hole formed near one end of said spring clip to releasably engage said first pin when said slots engage said at least one prong and a second hole formed near the second end of said spring clip to releasably engage said second pin when said slots are in said open position.

24. A method for adjusting the length of a cinch belt of saddle, said cinch belt having a first strap portion and a second strap portion wherein said method comprises the steps of:

(a) inserting one end of said first strap portion through transverse slot means formed in said second strap portion;

(b) inserting one end of said second strap portion through transverse slot means formed in said first strap portion;

(c) moving said first strap portion and said second strap portion relative to one another until the cinch belt has been adjusted to the desired length;

(d) inserting the upstanding prongs of a first locking plate through holes formed in said first strap portion and holes formed in said second strap portion to prevent said strap portions from moving relative to another;

(e) inserting said upstanding prongs through the holes formed in a second locking plate to prevent said strap portions from coming off said prongs;

(f) sliding a third plate relative to said second plate so that the edges of slots formed in said third plate engage notches formed in said prongs to lock said second locking plate to said first locking plate;

(g) securing spring biasing means on said third plate to releasably bias said slot edges into engagement with said notches.

25. The method of claim 24 further comprising the steps (h) releasing said spring biasing means on said third plate to release said slot edges from engagement from said notches;

(i) removing said second plate from said upstanding prongs;

(j) removing said strap portions from said prongs;

(k) readjusting the length of said strap portions;

(l) repeating steps (d)–(g).

* * * * *